US010669863B2

(12) United States Patent
Benichou et al.

(10) Patent No.: US 10,669,863 B2
(45) Date of Patent: Jun. 2, 2020

(54) BLADE, BLADED WHEEL, TURBOMACHINE, AND A METHOD OF MANUFACTURING THE BLADE

(71) Applicant: SNECMA, Paris (FR)

(72) Inventors: Sami Benichou, Le Blanc-Mesnil (FR); Christian Bariaud, Orsay (FR); Stéphanie Deflandre, Conflans-Saint-Honorine (FR); Sébastien Digard Brou De Cuissart, Blackrock (FR); Patrick Emilien Paul Emile Huchin, Tessancourt sur Aubette (FR)

(73) Assignee: Safran Aircraft Engines, Paris (FR)

( * ) Notice: Subject to any disclaimer, the term of this patent is extended or adjusted under 35 U.S.C. 154(b) by 592 days.

(21) Appl. No.: 15/105,406

(22) PCT Filed: Dec. 12, 2014

(86) PCT No.: PCT/FR2014/053317
§ 371 (c)(1),
(2) Date: Jun. 16, 2016

(87) PCT Pub. No.: WO2015/092234
PCT Pub. Date: Jun. 25, 2015

(65) Prior Publication Data

US 2016/0319676 A1 Nov. 3, 2016

(30) Foreign Application Priority Data

Dec. 18, 2013 (FR) ..... 13 62910

(51) Int. Cl.
*F01D 9/04* (2006.01)
*F01D 5/22* (2006.01)
(Continued)

(52) U.S. Cl.
CPC ..... *F01D 5/225* (2013.01); *F01D 5/143* (2013.01); *F01D 5/3007* (2013.01); *F01D 9/041* (2013.01);
(Continued)

(58) Field of Classification Search
CPC ..... F01D 5/225; F01D 5/3007; F01D 9/041; F01D 5/143; F05D 2230/50; F05D 2260/81; G06F 17/5086; G05B 19/4097
See application file for complete search history.

(56) References Cited

U.S. PATENT DOCUMENTS 3,873,234 A 3/1975 Penny
4,602,412 A 7/1986 Partington et al.
(Continued)

FOREIGN PATENT DOCUMENTS

CN 1379165 A 11/2002
CN 102733858 A 10/2012
(Continued)

OTHER PUBLICATIONS

International Search Report in corresponding International Application No. PCT/FR2014/053317 dated Mar. 18, 2015 (6 pages—English translation included).
(Continued)

*Primary Examiner* — Richard A Edgar
*Assistant Examiner* — Maxime M Adjagbe
(74) *Attorney, Agent, or Firm* — Bookoff McAndrews, PLLC

(57) ABSTRACT

A blade for a turbomachine bladed wheel having N blades. At one end, the blade presents a platform that is formed integrally with an airfoil of the blade.
Over a portion of the axial extent of the blade, a section through the platform wall on a plane perpendicular to the axis (X) of the wheel is constituted mainly by two first straight line segments arranged respectively on the two sides of the airfoil.
(Continued)

Each of these segments forms an angle of 90°-180°/N relative to the radial direction on either side of the airfoil.

13 Claims, 3 Drawing Sheets

(51) Int. Cl.
*F01D 5/30* (2006.01)
*F01D 5/14* (2006.01)

(52) U.S. Cl.
CPC ..... *F05D 2220/30* (2013.01); *F05D 2230/50* (2013.01); *F05D 2260/81* (2013.01)

(56) References Cited

U.S. PATENT DOCUMENTS

| | | | | |
|---|---|---|---|---|
| 2007/0020102 | A1 | 1/2007 | Beeck et al. | |
| 2011/0299980 | A1 | 12/2011 | Ström et al. | |
| 2013/0101395 | A1* | 4/2013 | Miller | F01D 5/16 415/119 |

FOREIGN PATENT DOCUMENTS

| | | | |
|---|---|---|---|
| EP | 1734227 | A1 | 12/2006 |
| EP | 2505784 | A1 | 10/2012 |
| FR | 2715968 | A1 | 8/1995 |
| GB | 2293212 | A | 7/1986 |
| GB | 2251897 | A | 7/1992 |
| JP | 2001-055902 | A | 2/2001 |
| JP | 2006-348937 | A | 12/2006 |
| JP | 2007-016778 | A | 1/2007 |
| JP | 2012-140971 | A | 7/2012 |

OTHER PUBLICATIONS

Examination Report (English Translation) dated Sep. 18, 2018, in corresponding Japanese Application 2016-541097 (7 pages).
English language translation of First Office Action issued in corresponding Chinese Application No. 201480069046.7 dated Mar. 3, 2017 (6 pages).
English translation of Japanese Office Action in Japanese Patent Application No. 2016-541097, dated Jun. 25, 2019 (9 pages).

* cited by examiner

BLADE, BLADED WHEEL, TURBOMACHINE, AND A METHOD OF MANUFACTURING THE BLADE

CROSS REFERENCE TO RELATED APPLICATIONS

This application is the U.S. national phase entry under 35 U.S.C. § 371 of International Application No. PCT/FR2014/053317, filed on Dec. 12, 2014, which claims priority to French Patent Application No. 1362910, filed on Dec. 18, 2013.

The present invention relates to a blade for a turbomachine bladed wheel having N blades arranged around a wheel axis: a first end of the blade having a first platform presenting a surface, referred to as a "platform wall", on a side toward an airfoil of the blade. The number N is an integer equal to the number of blades contained in the bladed wheel.

Such a bladed wheel may be a rotor wheel and thus receive energy coming from the stream or communicate energy to the stream flowing through the bladed wheel; it may also be a stator wheel, in which case it serves to guide the stream.

Below, the term "platform wall" is used to designate the surface of a platform of the blade that faces towards the airfoil.

A blade for a turbomachine bladed wheel, in particular when it has a tip with a tip platform wall and a root with a root platform wall, constitutes a part that is complex in shape. It is thus relatively difficult to fabricate, and usually requires molds or tooling to be used that include multiple parts, and/or possibly require recourse to five-axis machining centers.

It can be understood these are blades that are fabricated essentially by casting (although other methods could be envisaged), and in which the platform(s) is/are formed integrally with the airfoil.

An object of the invention is thus to remedy these drawbacks and to propose blades that are simpler or easier to fabricate than traditional blades.

In a blade of the type specified in the introduction in which the first platform is formed integrally with the airfoil, this object is achieved by the fact that over a first portion of the axial extent of the blade, a section in a plane perpendicular to the axis of the wheel through the wall of the first platform is constituted essentially by a first straight line segment on a first side of the airfoil and by a second straight line segment on the second side of the airfoil; and each of the first and second segments forms an angle of 90°-180°/N relative to the radial direction on either side of the airfoil.

The first portion of the axial extent of the blade may in particular extend upstream from the airfoil, or downstream from the airfoil (while possibly also extending axially in register with the blade). The first axially extending portion of the blade may in particular extend upstream beyond the connection fillet of the leading edge of the blade, and/or downstream beyond the downstream connection fillet of the trailing edge of the blade.

Consequently, when two blades as defined above are placed one next to the other (a first blade and a second blade), in the same position as when they are assembled in a bladed wheel, in the "inter-airfoil" space situated between the airfoils of the two blades, in a plane perpendicular to the axis of the wheel and situated axially in the first portion of the blade, the section of the first blade is constituted essentially by a segment (which may be thought of as the first segment) that is in alignment with the segment constituting essentially the section of the second blade. Thus, a section in a plane perpendicular to the axis of the wheel of the first platform walls of the two blades present two straight line segments in alignment, i.e. the first segment for the first blade and the second segment for the second blade. Preferably, the first segment and the second segment have ends that are adjacent.

The first and second segments define two vectors, which when projected onto a plane perpendicular to the axis of the bladed wheel, are symmetrical about a meridian plane of the bladed wheel passing through the blade.

These two vectors define respective "fabrication directions" for the two sides of the blade. Because of the straight line shape of the platform wall section in these directions on either side of the airfoil in the first portion of the axial extent of the blade, the platform wall is relatively simple to fabricate using various fabrication methods (molding, spark erosion machining, machining, . . . ).

Furthermore, and advantageously, in the first portion of the axial extent of the blade, the walls of the first platform present perfect continuity at the interface between two adjacent blades.

The above-specified blade shape also implies that the first and second segments form an acute angle relative to the outward radial direction of the blade.

In an embodiment, over the entire axial extent of the blade, a section on a plane perpendicular to the axis of the wheel through the wall of the first platform is essentially constituted by a first straight line segment on a first side of the airfoil and by a second straight line segment on the second side of the airfoil; and each of the first and second segments forms an angle of 90°-180°/N on either side of the airfoil.

In an embodiment, the second end of the blade has a second platform; over a second portion of the axial extent of the blade, a section on a plane perpendicular to the axis of the wheel through a wall of the second platform is essentially constituted by a third straight line segment on a first side of the airfoil and by a fourth straight line segment on the second side of the airfoil; and each of the third and fourth segments forms an angle of 90°-180°/N relative to the radial direction on either side of the airfoil.

Preferably, the first and second portions of the axial extent of the blade are identical.

In this embodiment, fabrication of the blade is thus particularly simplified. Specifically, because of the above-specified shape for the blade platform walls, the tip and root platform walls are parallel to each other at the ends of the blade: i.e. the sections of the tip and root platform walls in a plane perpendicular to the axis of the wheel, both on the pressure side and on the suction side of the blade, are constituted essentially by respective segments for the tip and root platform walls and these two segments are parallel to each other.

Thus, on either side of the blade, the tip and root fabrication directions are parallel. The method of fabrication, and thus generally the fabrication tooling, can therefore be relatively simple.

In an embodiment, the first platform presents an edge that substantially extends the leading edge of the blade and/or an edge that substantially extends the trailing edge of the blade.

It is found that the presence of an edge at this or these locations does not excessively disturb the flow of fluid around the blade, but makes it possible to use tooling of simple shape for fabricating the blade.

The invention also provides a bladed wheel having N blades as defined above, and also a turbomachine, in particular a two-spool turbomachine having a low pressure turbine with such a bladed wheel.

A second object of the invention is to propose a method of modeling a platform wall for a blade that makes it possible to define a blade that is particularly easy to fabricate, in particular in comparison with prior art blades.

This object is achieved when the blade platform wall is modeled using the following steps:

with a computer, creating a digital model of the platform wall in such a manner that over a first portion of the axial extent of the blade, and possibly over the entire axial extent of the blade, a section of the platform wall on a plane perpendicular to the axis of the wheel essentially forms a first straight line segment on a first side the airfoil and a second straight line segment on the second side of the airfoil, and each of the first and second segments forms an angle of 90°-180°/N relative to the radial direction on either side of the airfoil; and that the platform of the blade appears as being integrally formed with the airfoil.

The term "radial direction" is used herein to designate the direction that is radial at the airfoil of the blade.

This method makes it possible to obtain a digital model of a blade as defined above.

In order to enable the digital model of the wall of the first platform of the blade to be created, the method may include the following steps:

determining a theoretical surface for the airfoil, referenced relative to an axis of the bladed wheel; and defining a first construction curve for the blade.

The first construction curve then makes it possible to construct the platform wall support surface.

By way of example, the first construction curve may be constructed as follows: the method may include a step during which a theoretical airfoil surface is determined; and then, the first construction curve is determined in such a manner that it extends from upstream to downstream the theoretical airfoil surface, passing right through it, and is radially at substantially the same distance from the axis as an intersection between the theoretical airfoil surface and the theoretical platform wall surface.

Furthermore, and preferably, it is possible to determine the first construction curve in such a manner that outside the theoretical airfoil surface the first construction curve is contained in the theoretical platform wall surface.

These provisions make it simple to define the first construction curve in such a manner that the platform wall that is created is close to the theoretical surface for the platform wall. This surface is the platform wall surface that is calculated for the purpose, in principle, of having a platform that is aerodynamically ideal. Consequently, the calculated platform wall presents high-level aerodynamic performance.

Furthermore, it is possible preferably to define the first construction curve in such a manner that its intersection with the theoretical surface for the platform wall is constituted exactly by two points.

In addition, it is possible preferably to define the first construction curve in such a manner that for at least one direction, namely the above-mentioned fabrication direction, in the vicinity of the theoretical surface for the platform wall there is an angle between the normal to the theoretical surface of the airfoil and said direction that is an acute angle or a right angle, both on the pressure side and on the suction side.

In order to satisfy this criterion, the first construction curve may in particular cross the theoretical airfoil surface at points where the normal is perpendicular to the intended fabrication direction.

The above-mentioned methods of calculating the first construction curve make it possible to obtain a first construction curve that provides a good support for calculating the wall of the first platform.

The first construction curve is then used when calculating the platform wall.

Various methods can enable the platform wall to be created.

For example, it is possible to begin by creating a platform wall support surface that is defined in such a manner that over the entire axial extent of the first construction curve, a section of the platform wall support surface in a plane perpendicular to the axis is constituted by a straight line segment.

The platform wall support surface is a surface used for constituting the platform wall proper: on either side of the airfoil, the platform wall is created from the platform wall support surface, in particular by limitation (restriction) operations, specifically for limiting (restricting) the platform wall support surface at a limitation curve that is the curve that substantially defines the limit between two adjacent blades (ignoring any inter-blade clearance).

The above-described first construction curve can thus be used for creating the platform wall support surface in various ways.

In one implementation, the platform wall support surface is created by performing the following operations:

defining a second construction curve for the blade, by applying rotation through an angle of 360°/N about the axis of the wheel to the first construction curve; and defining a platform wall support surface (a first platform wall support surface) by sweeping a straight line segment that moves while bearing against the first and second construction curves.

The term "bearing against" is used herein to mean that the straight line segment remains in contact at all times with both construction curves.

The straight line segment moves while remaining at all times in a plane perpendicular to the axis of the wheel.

The platform wall is thus created in such a manner as to include a portion of this platform wall support surface. The platform wall is obtained from the platform wall support surface in particular by limiting it at the limitation curve defining the limit between adjacent blades.

Because it is constructed by sweeping a straight line segment that moves over the first and second construction curves while bearing against them, over the entire axial extent (relative to the axis of the bladed wheel) of the construction curves, the section of the platform wall support surface follows a plane that is perpendicular to this axis and is constituted by a straight line segment.

By construction, the platform wall support surface as defined above extends solely on one side of the theoretical airfoil surface, i.e. towards the pressure side or towards the suction side. To create a platform wall support surface on the second side of the theoretical airfoil surface, it is possible for example to perform the following operation:

creating a second platform wall support surface by applying a second rotation relative to the axis through an angle of −360°/N to the first platform wall support surface (where the first rotation that was used for constructing the second construction curve and the second rotation are performed in opposite directions).

The platform wall is then defined in such a manner as to include, axially at least a fraction of the first construction curve, two portions respectively of the first and second platform wall support surfaces that are situated on either side of the theoretical airfoil surface.

Creating the platform wall requires in particular eliminating from the first and second platform wall support surfaces those surface portions that are not to form parts of the platform wall. This relates in particular to the platform wall support surface portions that are:

situated inside the theoretical airfoil surface; and/or situated between the theoretical airfoil surface and connection fillets connecting it to one of the theoretical platform wall support surfaces.

The platform wall is finalized by limiting its surface by means of limitation curves, on either side of the airfoil.

The invention also provides a method of fabricating a blade for a turbomachine bladed wheel, a first end of the blade having a first platform presenting a platform wall surface facing the airfoil of the blade, wherein in order to define the platform wall, use is made of a platform wall modeling method as defined above, and in which the first platform is made integrally with the airfoil.

In this method, the blade is preferably made mainly by casting.

The invention also relates to performing the platform wall-modeling method as defined above, by using the CATIA (registered trademark) CAD tool.

Finally, the invention also provides a computer program including instructions for enabling a computer to execute steps of the platform wall modeling method as defined above, a computer readable data medium storing a computer program as defined above, and a computer including a data medium as defined above.

The invention can be well understood and its advantages appear better on reading the following detailed description of embodiments shown as non-limiting examples. The description refers to the accompanying drawings, in which.

Figure 1:
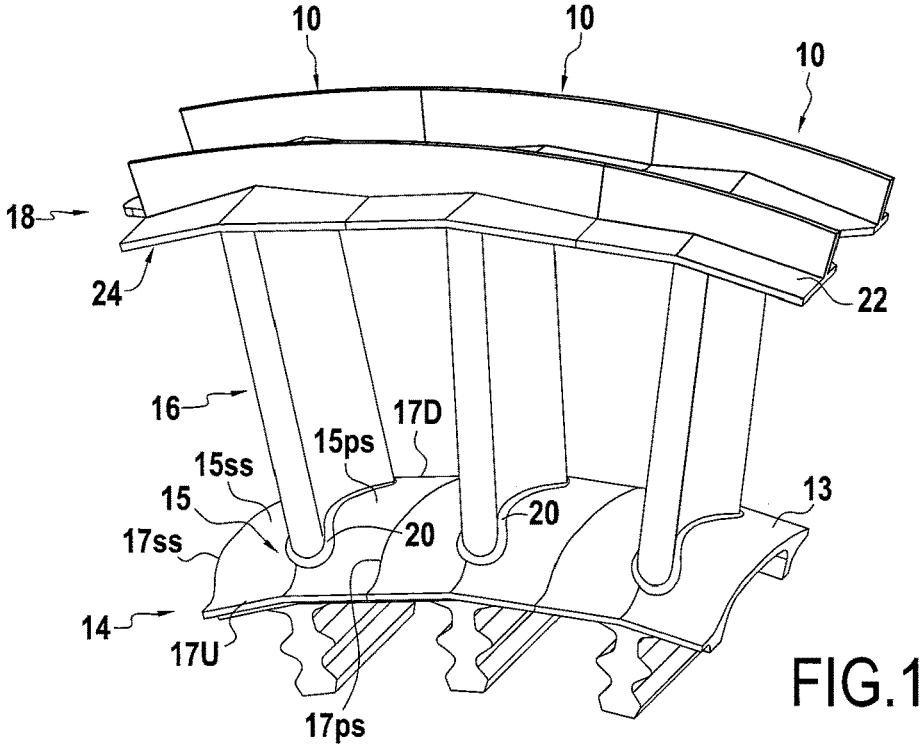
FIG. 1 is a diagrammatic perspective view of a blade of the invention.
Figure 2:
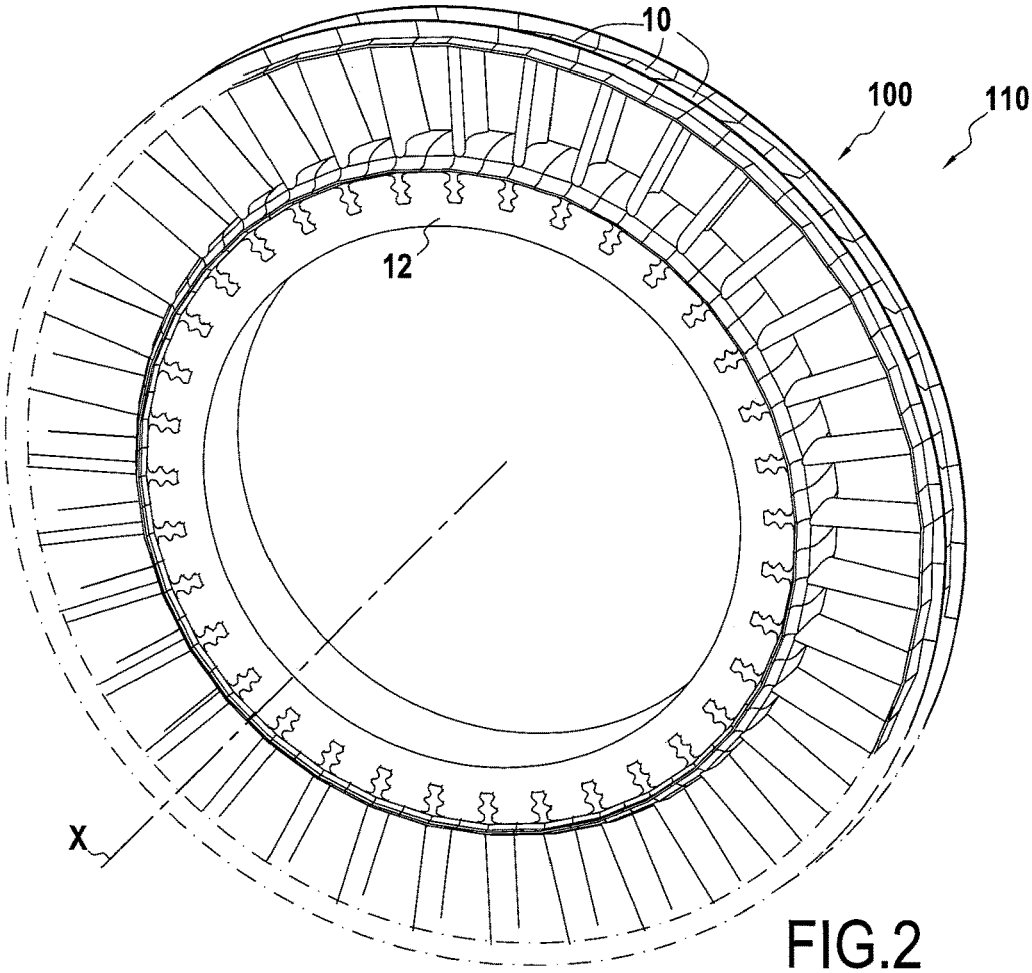
FIG. 2 is a fragmentary diagrammatic perspective view of a turbomachine showing a bladed wheel including blades identical to those shown in FIG. 1.

FIG. 1 shows three identical blades 10 representing an embodiment of the invention. Each of the blades 10 is designed to be assembled together with N−1 identical blades 10 so as to form a bladed wheel 100 comprising N blades 10 (FIG. 2).

The bladed wheel 100 itself forms part of a turbomachine 110.

In the wheel 100, the blades 10 are mounted on a rotor disk 12 in axisymmetric manner around the axis X of the wheel. When the wheel is in use, a fluid stream flows along the axis X from an upstream side to a downstream side of the wheel.

In the description below, elements associated with the upstream side are written "u", while elements associated with the downstream side are written "d".

Each blade 10 comprises in succession in a radial direction going outwards from the wheel: a root 14, an airfoil 16, and a tip 18.

The root 14 and the tip 18 thus constitute the two ends of the blade. They include respective platforms 13 and 22. These platforms 13 and 22 extend in a direction that is generally perpendicular to the longitudinal direction of the airfoil 16 (which is the radial direction R for the blade 10).

The root platform 13 presents a platform wall 15 and the platform 22 of the tip presents a platform wall 24.

In a radial view, the platform wall 15 presents an outline that is approximately rectangular, being defined by an upstream edge 17*u*, a downstream edge 17*d*, a pressure side edge 17*ps*, and a suction side edge 17*ss*.

The platform wall 15 is made up of two complementary portions: a portion 15*ps* situated on the pressure side and a portion 15*ss* situated on the suction side of the airfoil.

The platform wall 15 is connected to the surface of the airfoil 16 by connection surfaces 20 (which are substantially connection fillets of varying radius).

The modeling method used for defining the shape of the blade 10 in accordance with the invention is described below.

This method comprises the following operations:

a) determining the theoretical surface of the airfoil;

b) determining the theoretical surface of the platform wall;

c) determining construction curves for the blade; and d) creating the platform wall.

These operations are performed on a computer, using a computer assisted design program, e.g. such as the CATIA (registered trademark) software from Dassault Systèmes.

The various creation operations mentioned below are thus operations of creating three-dimensional entities, which entities are defined in a virtual three-dimensional environment or space.

a) Determining a Theoretical Airfoil Surface

Figure 3:
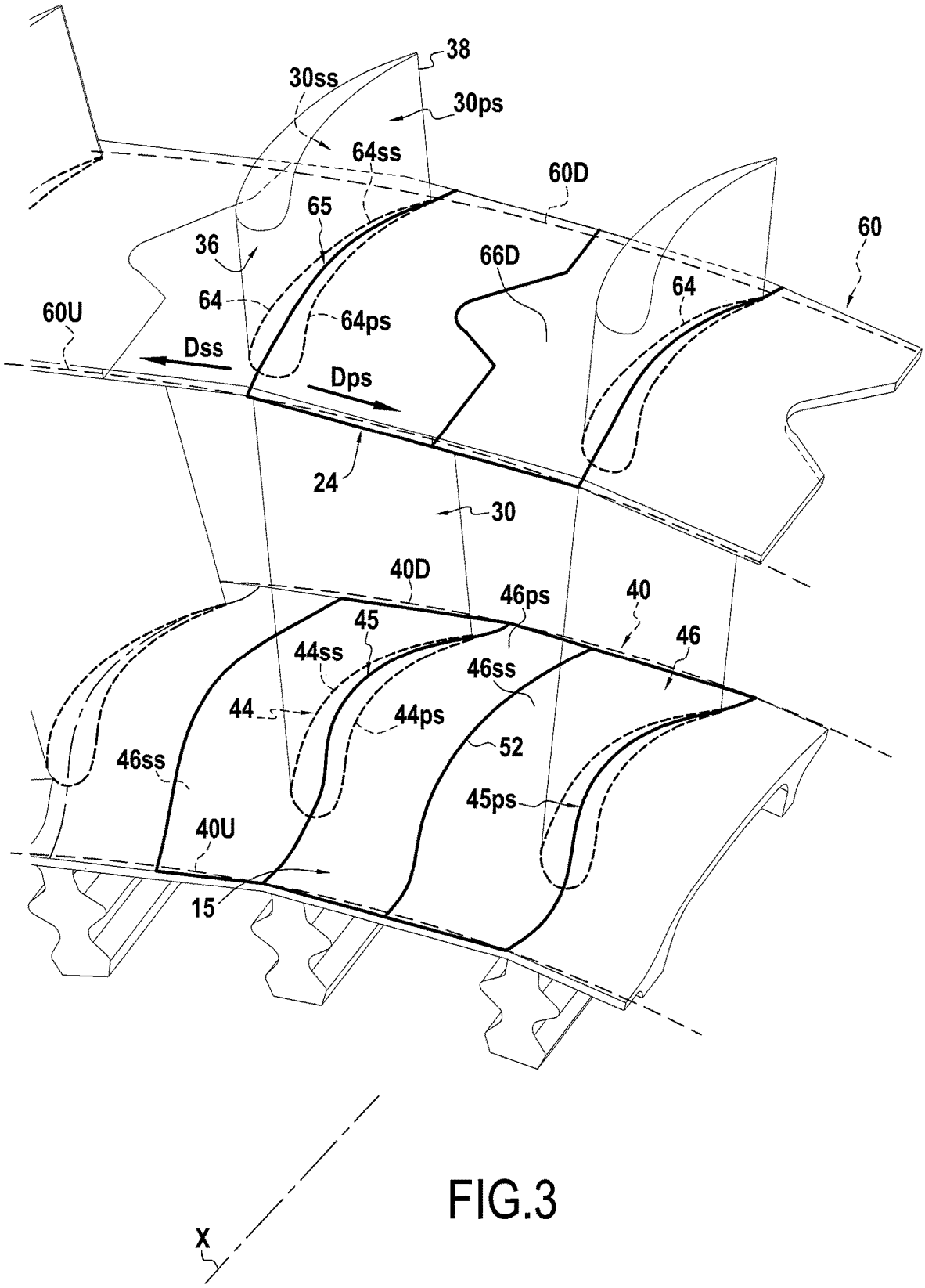
FIG. 3 is a diagrammatic perspective view of a digital model of the FIG. 1 blade while it is being created by the modeling method of the invention.

A theoretical airfoil surface 30 is created initially. This surface represents the outside surface desired for the airfoil 16. This surface is a function in particular of the aerodynamic constraints that are applicable to the airfoil; the airfoil is constituted by a suction side 30*ss* and a pressure side 30*ps*, and it presents a leading edge 36 and a trailing edge 38 (FIG. 3).

b) Determining Theoretical Platform Wall Surface

Thereafter a theoretical root platform wall surface 40 and a theoretical tip platform wall surface 60 are created or determined. Each of these surfaces has substantially the shape desired for the inner or outer casing defining the gas flow passage through the bladed wheel.

The surfaces 40, 60 extend axially upstream and downstream to the limit curves (40U, 40D, 60U, 60D) that define axially the extent and the footprint of the blade that is to be defined.

In the example described, the surfaces 40 and 60 are surfaces of revolution defined around the axis A. That said, theoretical surfaces for the platform wall that are not surfaces of revolution can also be used in the ambit of the invention, for example surfaces leading to defining so-called "3D" platforms that include local projections and/or depressions.

The term "surface of revolution" about an axis is used herein to mean a surface generated by rotating a curve around the axis.

c) Creating Blade Construction Curves

After defining the support entities that are constituted by the theoretical airfoil and platform wall surfaces (30; 40, 60), first construction curves 45 and 65 are created respectively for the platform 13 of the root 14 and for the platform 22 of the tip 18 of the blade 10.

For this purpose, the intersection curve 44 is determined between the theoretical airfoil surface 30 and the theoretical root platform wall surface 40.

The intersection curve 64 is also determined between the theoretical airfoil surface 30 and the theoretical tip platform wall surface 60.

Thereafter, fabrication directions are defined. These are defined by a pair of (normalized) vectors Dps, Dss. These vectors define respectively for the two sides of the airfoil the directions that enable the fabrication method that is used for the airfoil to be defined. For example, they define unmolding directions, etc.

Looking along the axis X of the bladed wheel, each of the vectors Dps and Dss is at an angle $\alpha$ equal to 90°-180°/N relative to the radial direction R, where N is the number of blades in the bladed wheel (FIG. 5), and the angle at the apex (on the axis X) between two adjacent blades is thus equal to 360°/N.

Figure 4:
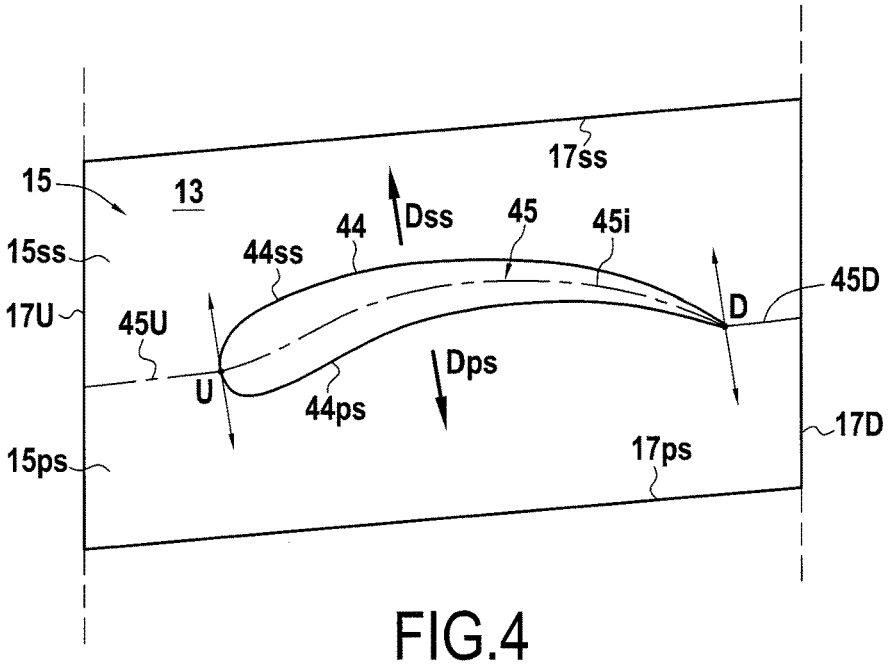
FIG. 4 is a diagrammatic view that is radial relative to the axis of the bladed wheel, showing the digital model of the FIG. 1 blade while it is being created by the modeling method of the invention.

In contrast, in projection onto a plane perpendicular to the radial direction, the vectors Dps and Dss are oriented in opposite directions (FIG. 4).

The vectors Dps and Dss are thus symmetrical to each other about a plane extending in a radial direction (R) through the theoretical airfoil surface 30 and containing the axis X of the bladed wheel.

There follows a detailed description of how the fabrication directions (vectors Dps and Dss) and the first construction curve 45 for the root platform 13 are determined, the same method subsequently being used for determining the first construction curve 65 for the tip platform 22.

For a given curve of intersection between the theoretical blade surface and a theoretical platform wall surface (in the present example the intersection curve is the curve 44), each fabrication direction (as defined by the pair of vectors Dps and Dss) corresponds to a pair of points (U, D) referred to as "limit" points, which are defined as follows:

A pair of limit points (U, D) is the pair of points generally situated respectively in the vicinity of the leading edge 36 and in the vicinity of the trailing edge 38 of the blade, that form part of the intersection curve under consideration (curve 44), and that subdivide it into two complementary portions (44*ps* and 44*ss*) associated respectively with the vectors Dps and Dss, and such that, at any point on each of these portions (44*ps* and 44*ss*), the angle between the normal to the theoretical airfoil surface at the point under consideration forms an acute angle or a right angle with the associated vector Dps or Dss.

In other words, at each point on one of these curved portions, the theoretical airfoil surface presents a non-negative draught relative to the vector Dps, Dss associated with that curved portion.

In general, this means that in a radial view (FIG. 4), the tangent to the intersection curve (to the curve 44) at the limit points (U, D) is parallel to the fabrication direction (Dps, Dss), as shown in FIG. 4.

A fabrication direction (pair of vectors Dps and Dss) is selected, thereby defining a pair of limit points U, D.

Thereafter, the first construction curve 45 for the root platform is defined so as to comply with the following constraints:

the curve 45 must pass via the limit points U and D;

it must extend upstream and downstream to the respective upstream and downstream limit curves 40U and 40D of the theoretical platform wall surface 40; and it must connect together the points U and D without crossing the theoretical airfoil surface 30 between these points.

The first construction curve 45 thus comprises:

a portion 45*i* inside the curve 44, having its end at the points U and D. In radial view (FIG. 4), this curve portion 45*i* extends inside the curve 44; and two curve portions 45*u* and 45*d* that are formed on the theoretical root platform wall surface 40 respectively from the point U to the curve 40*u* and from the point D to the curve 40*d*.

Thereafter, a second construction curve 45*ps* is created by rotating the first construction curve 45 through an angle 360°/N relative to the axis X.

The first and second construction curves 65, 65*ps* for the tip platform 22 are then created in analogous manner.

d) Creating the Root and Tip Platform Walls

The root platform wall 15 is initially constructed by performing the following operations:

a platform wall support surface 46 is created by sweeping a straight line segment that moves while continuing to bear against or be in contact with the first construction curve 45 and the second construction curve 45*ps*.

Figure 5:
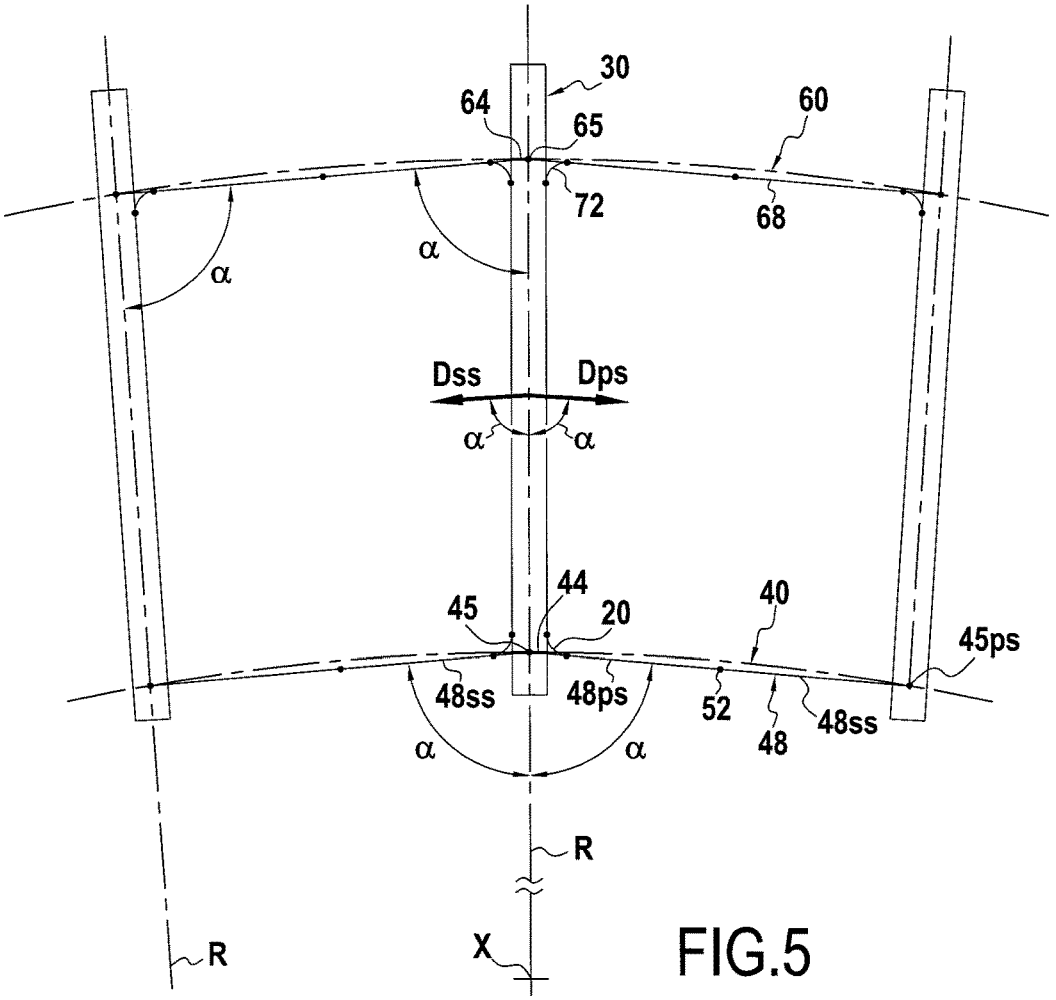
FIG. 5 is a diagrammatic view looking along the axis of the bladed wheel, in the digital model of the FIG. 1 blade while it is being created by the modeling method of the invention.

The section of the platform wall support surface 46 in a plane perpendicular to the axis X is shown in FIG. 5.

Because the surface 46 is constructed by sweeping a straight line segment between two curves 45 and 45*ps* over the entire axial extent of the curve 45, the section of the platform wall support surface 46 in a plane perpendicular to the axis is a straight line segment 48.

the platform wall 15 is then created.

To do this, surfaces 20 are initially calculated for the connection fillets between the theoretical airfoil surface 30 and the platform wall support surface 46, on the pressure side.

The platform wall support surface 46 is then limited at the ends of the connection fillet surfaces 20.

Upstream and downstream from the theoretical airfoil surface 30, the platform wall support surface extends to the first construction curve 45.

Thereafter, the desired limitation curve 52 defining the platforms of adjacent blades is initially given or created. The platform wall support surface 46 is then divided into two portions 46*ps* and 46*ss* that are separated by the limitation curve 52.

The portion 46*ss* of the platform wall support surface 46 is then subjected to rotation through an angle of −360°/N about the axis X; the portion 46*ss* to which this rotation is applied is thus situated relative to the theoretical airfoil surface on the suction side.

The surfaces 20 of the connection fillets between the theoretical airfoil surface 30 and the platform wall support surface 46*ss* on the suction side are calculated initially.

The platform wall support surface 46*ss* is then limited at the ends of the connection fillet surfaces 20.

This portion 46*ss* (situated on the suction side of the theoretical airfoil surface 30) and the portion 46*ps* together constitute the wall 15 of the platform 13 of the root 14 of the blade 10.

(In another embodiment, only a fraction of the above-mentioned surfaces 46*ss* and 46*ps* is used for creating the platform wall 15. In addition to these fractions of the surfaces 46*ss* and 46*ps*, the platform wall 15 then also has surfaces other than the surfaces 46*ss* and 46*ps*, e.g. surface fractions that are not surfaces of revolution.)

Upstream and downstream from the airfoil 16, the portions 46*ss* and 46*ps* of the platform wall support surface are adjacent and form a projecting edge at the first construction curve 45, i.e. at the curves 45*u* and 45*d*.

Conversely, at the limitation curve 52, the adjacent surfaces 46*ps* and 46*ss* are in perfect continuity.

By construction, on either side of the theoretical airfoil surface 30, the sections 48*ss* and 48*ps* of the platform wall support surface portions 46*ss* and 46*ps* form an angle $\alpha$ equal to 90-180°/N relative to the radial direction R (FIG. 5).

It also follows that over the entire axial extent of the blade, a section on a plane perpendicular to the axis of the wheel through the platform wall 15 presents a first straight line segment 48*ps* on a first side of the airfoil and a second straight line segment 48*ss* on the second side of the airfoil; each of these first and second segments 48*ss* and 48*ps* forms an angle of 90°-180°/N on either side of the airfoil relative to the radial direction R.

The tip platform wall 24 is created in the same manner as the root platform wall 15.

Consequently, the sections of the support surfaces for the tip and root platform walls present parallel straight line segments 48, 68 in a plane perpendicular to the axis X.

The theoretical airfoil surface 30 is limited at the connection fillets 20 on the root side. It is limited in the same way at the connection fillets 72 that are created on the tip side.

The digital model of the entire blade is then finalized by incorporating therein specifically the platform walls 15 and 24, the connection fillets 20 and 72, and the theoretical airfoil surface 30, once the limits have been applied.

The blade 10 can then be fabricated with the shape defined by the digital model as defined in this way.

The invention claimed is:

1. A blade for a turbomachine bladed wheel having N blades arranged around a wheel axis:

a first end of the blade having a first platform presenting a surface, referred to as a wall of the first platform, on a side toward an airfoil of the blade;

wherein the first platform is formed integrally with the airfoil, and in that over a first portion of the axial extent of the blade, a section in a plane perpendicular to the axis of the turbomachine bladed wheel through the wall of the first platform is constituted essentially by a first straight line segment on a first side of the airfoil and by a second straight line segment on a second side of the airfoil; and each of the first and second segments forms an angle of 90°-180°/N relative to the radial direction on either side of the airfoil, wherein N>2.

2. The blade according to claim 1, wherein over the entire axial extent of the blade, a section on a plane perpendicular to the axis of the turbomachine bladed wheel through the wall of the first platform is essentially constituted by a first straight line segment on a first side of the airfoil and by a second straight line segment on the second side of the airfoil; and each of the first and second segments forms an angle of 90°-180°/N relative to the radial direction on either side of the airfoil.

3. The blade according to claim 1, wherein the second end of the blade has a second platform;

over a second portion of the axial extent of the blade, a section on a plane perpendicular to the axis of the turbomachine bladed wheel through a wall of the second platform is essentially constituted by a third straight line segment on a first side of the airfoil and by a fourth straight line segment on the second side of the airfoil; and each of the third and fourth segments forms an angle of 90°-180°/N relative to the radial direction on either side of the airfoil.

4. The blade according to claim 1, wherein the first platform presents an edge that substantially extends a leading edge of the blade and/or an edge that substantially extends a trailing edge of the blade.

5. The blade according to claim 1, wherein said first portion of the axial extent of the blade extends upstream from the airfoil and/or downstream from the airfoil.

6. A bladed wheel including a number N of blades according to claim 1.

7. A turbomachine including the bladed wheel according to claim 6.

8. A turbomachine including the bladed wheel according to claim 6, wherein the turbomachine is a two-spool turbomachine having a low pressure turbine.

9. A method of fabricating a blade for a turbomachine bladed wheel, a first end of the blade having a first platform presenting a surface referred to as the platform wall on a side toward an airfoil of the blade; wherein, in order to define the platform wall, use is made of a platform wall modeling method, the platform wall modeling method including the following steps:

with a computer, creating a digital model of the platform wall in such a manner that over a first portion of the axial extent of the blade, a section of the platform wall on a plane perpendicular to the axis of the bladed wheel has a first straight line segment on a first side of the airfoil of the blade and a second straight line segment on a second side of the airfoil, and each of the first and second segments forms an angle of 90°-180°/N relative to the radical direction on either side of the airfoil; wherein N>2, and in that the first platform is formed integrally with the airfoil.

10. The method of fabricating a blade for a turbomachine bladed wheel according to claim 9, wherein said first portion of the axial extent of the airfoil extends upstream from the airfoil and/or downstream from the airfoil.

11. The method of fabricating a blade for a turbomachine bladed wheel according to claim 9, further including the following steps:

determining a theoretical surface for the airfoil, referenced relative to an axis of the bladed wheel;

defining a first construction curve for the blade; and defining a second construction curve by applying a rotation through an angle 360°/N about the axis of the wheel to the first construction curve; and wherein in order to create the platform wall, a platform wall support surface is created by sweeping a straight line segment that moves while bearing against the first and second construction curves; and the platform wall is created so as to include a portion of said platform wall support surface defined by a limit curve that substantially defines a limit between two adjacent blades.

12. The method of fabricating a blade for a turbomachine bladed wheel according to claim 11, further including the following step:

determining a theoretical surface for the platform wall;

and wherein the first construction curve is then determined in such a manner that it extends from upstream to downstream the theoretical airfoil surface, passing right through it, and is radially at substantially the same distance from the axis as an intersection between the theoretical airfoil surface and the theoretical platform wall surface.

13. The method of fabricating a blade for a turbomachine bladed wheel according to claim 12, wherein the first construction curve is determined in such a manner that outside the theoretical airfoil surface the first construction curve is contained in the theoretical platform wall surface.

* * * * *